US007648346B2

(12) United States Patent
Murakami et al.

(10) Patent No.: US 7,648,346 B2
(45) Date of Patent: Jan. 19, 2010

(54) VARIABLE DISPLACEMENT COMPRESSOR

(75) Inventors: Tomohiro Murakami, Aichi-ken (JP); Sokichi Hibino, Aichi-ken (JP); Shiro Hayashi, Aichi-ken (JP); Yoshio Kimoto, Aichi-ken (JP); Yusuke Kita, Aichi-ken (JP); Hiroaki Kayukawa, Aichi-ken (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 339 days.

(21) Appl. No.: 11/109,060

(22) Filed: Apr. 18, 2005

(65) Prior Publication Data

US 2005/0244279 A1 Nov. 3, 2005

(30) Foreign Application Priority Data

Apr. 28, 2004 (JP) ..... 2004-134307
Dec. 28, 2004 (JP) ..... 2004-381234

(51) Int. Cl.
*F04B 1/29* (2006.01)

(52) U.S. Cl. ..... 417/222.2; 417/295; 417/441

(58) Field of Classification Search ..... 417/441
See application file for complete search history.

(56) References Cited

U.S. PATENT DOCUMENTS 4,905,477 A 3/1990 Kazuhiko ..... 62/196.3
5,577,894 A 11/1996 Kawaguchi et al. ..... 417/222.2
5,636,973 A * 6/1997 Sonobe et al. ..... 417/222.2
5,873,704 A 2/1999 Ota et al. ..... 417/222.2
6,257,848 B1 7/2001 Terauchi ..... 417/441
6,520,751 B2 2/2003 Fujita et al. ..... 417/295
2005/0244278 A1 * 11/2005 Hayashi et al. ..... 417/222.2

FOREIGN PATENT DOCUMENTS

CN 1316592 10/2001

(Continued)

OTHER PUBLICATIONS

Chinese Office Action dated Aug. 3, 2007, received in corresponding Chinese Patent Application No. 200510068466.6 with English translation.

(Continued)

*Primary Examiner*—Devon C Kramer
*Assistant Examiner*—Philip Stimpert
(74) *Attorney, Agent, or Firm*—Locke Lord Bissell & Liddell LLP

(57) ABSTRACT

A variable displacement compressor in which variable control of displacement is effected through adjustment of a crank chamber pressure, includes: a suction port; a suction chamber; a suction passage establishing communication between the suction port and the suction chamber; and an opening control valve arranged in the suction passage and adapted to adjust the opening of the suction passage based on a pressure difference between a suction pressure in the suction port and the crank chamber pressure.

14 Claims, 7 Drawing Sheets

FOREIGN PATENT DOCUMENTS

| | | | |
|---|---|---|---|
| EP | 0 707 182 | | 4/1996 |
| EP | 0992684 | A2 | 4/2000 |
| EP | 1001170 | A2 | 5/2000 |
| EP | 1122429 | A2 | 8/2001 |
| JP | 61-75563 | U | 5/1986 |
| JP | 03-009087 | A | 1/1991 |
| JP | 05-094220 | A | 4/1993 |
| JP | 11-148457 | A | 6/1999 |
| JP | 11-351142 | A | 12/1999 |
| JP | 2000-136776 | A | 5/2000 |
| JP | 2001-207958 | A | 8/2001 |
| JP | 2003-074728 | A | 3/2003 |

OTHER PUBLICATIONS

European Search Report issued on Jul. 15, 2009, for EP application No. 05008497.9.

Japanese Office Action mailed on Mar. 3, 2009 for Japanese Patent Application No. 2004-381234 (No English translation provided).

Japanese Office Action dated Sep. 29, 2009 for Japanese Patent Application No. 2004-381234 (no English translation provided).

* cited by examiner

VARIABLE DISPLACEMENT COMPRESSOR

BACKGROUND OF THE INVENTION

1. Field of the Invention

The present invention relates to a variable displacement compressor, and more particularly to a reduction in vibration and noise due to suction pulsation during variable displacement operation.

2. Description of the Related Art

Conventionally, a piston type compressor is equipped with a stopper so that the suction reed valve may not undergo self-excited vibration at the time of suction. However, in a piston type variable displacement compressor, the suction gas amount differs between the maximum displacement state and the variable displacement state. Thus, when the stopper provided is adjusted to the maximum displacement state, the suction reed valve does not open to a sufficient degree and does not abut the stopper when, in particular, the displacement is small, or when the compressor is started in the OFF state, in which the displacement is minimum. As a result, the suction reed valve generates self-excited vibration to cause suction pulsation, the vibration of which may be propagated to the exterior of the compressor to thereby generate noise.

In this regard, U.S. Pat. No. 6,257,848, for example, discloses a compressor in which there is arranged an opening control valve which controls the opening area of the suction passage, thereby mitigating the fluctuation in pressure when the flow rate is low.

However, in the above construction disclosed in U.S. Pat. No. 6,257,848, the opening control valve is operated by utilizing a pressure difference due to the gas flow in the suction passage and a spring force, so that when priority is given to the throttle effect, a throttle effect is also obtained when the displacement is maximum to thereby cause a deterioration in performance, whereas an attempt to secure the performance corresponding to the maximum displacement makes it impossible to effect throttling to a sufficient degree during small displacement operation, which requires a throttle effect.

SUMMARY OF THE INVENTION

The present invention has been made with a view toward solving the above problem in the prior art. It is an object of the present invention to provide a variable displacement compressor which can reliably achieve a reduction in vibration due to suction pressure fluctuation during variable displacement operation and which can secure a sufficient flow rate during maximum displacement operation, thus making it possible to secure the requisite performance.

A variable displacement compressor according to the present invention, in which variable control of displacement is effected through adjustment of a crank chamber pressure, includes: a suction port; a suction chamber; a suction passage establishing communication between the suction port and the suction chamber; and an opening control valve arranged in the suction passage and adapted to adjust the opening of the suction passage based on a pressure difference between a suction pressure in the suction port and the crank chamber pressure.

By exerting not only the suction pressure but also the crank chamber pressure, which varies according to the displacement, on the opening control valve, it is possible to suppress the throttle effect during maximum displacement operation and to exert the throttle effect to a sufficient degree during small displacement operation.

DETAILED DESCRIPTION OF THE PREFERRED EMBODIMENTS

In the following, embodiments of the present invention will be described with reference to the drawings.

Embodiment 1

Figure 1:
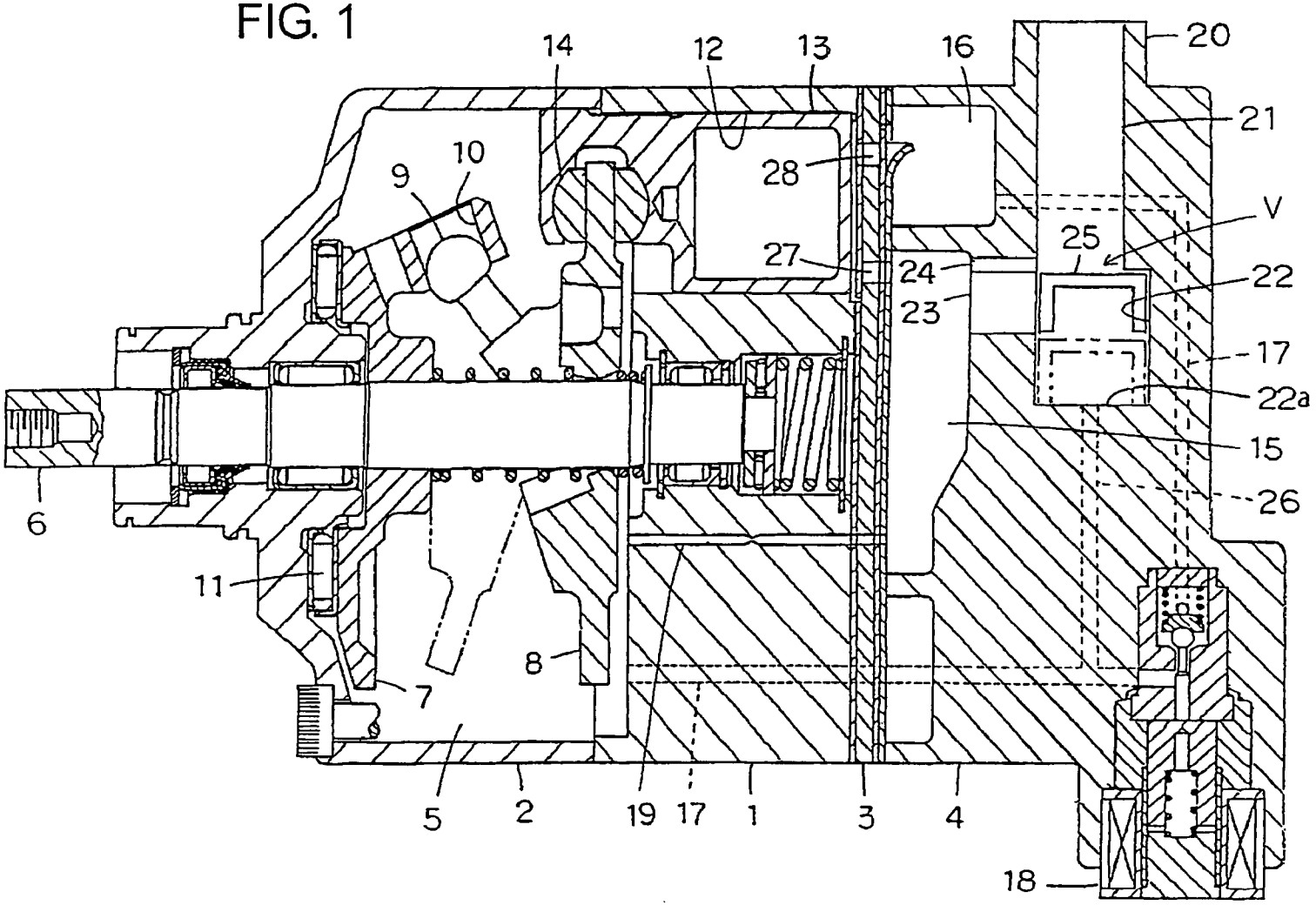
FIG. 1 is a sectional view showing a construction of a variable displacement compressor according to Embodiment 1 of the present invention.

FIG. 1 shows a construction of a variable displacement compressor according to Embodiment 1. A front housing 2 is connected to the front end portion of a cylinder block 1, and a rear housing 4 is connected to the rear end portion of the cylinder block 1 through the intermediation of a valve forming member 3. A crank chamber 5 is defined by the cylinder block 1 and the front housing 2, and a drive shaft 6 is rotatably supported by the cylinder block 1 and the front housing 2 so as to extend through the crank chamber 5. The forward end portion of the drive shaft 6 protrudes outwardly from the front housing 2 and is connected to a rotary drive source (not shown), such as a vehicle engine or a motor. Inside the front housing 2, a rotary support member 7 is fixed to the drive shaft 6, and a swash plate 8 is mounted so as to be engaged with the rotary support member 7. The swash plate 8 has at its center a through-hole, through which the drive shaft 6 extends, and, in this state, a guide pin 9 protruding from the swash plate 8 is slidably fitted into a guide hole 10 formed in the rotary support member 7. Due to the engagement of the guide pin 9 and the guide hole 10, the swash plate 8 rotates integrally with the drive shaft 6, and is supported so as to be capable of sliding in the axial direction of the drive shaft 6 and tilting. Further, the rotary support member 7 is rotatably supported by a thrust bearing 11 arranged in the front end inner wall portion of the front housing 2.

Inside the cylinder block 1, a plurality of cylinder bores 12 are formed and arranged around the drive shaft 6, and a piston 13 is slidably accommodated in each cylinder bore 12. Each piston 13 is engaged with the outer peripheral portion of the swash plate 8 through the intermediation of a shoe 14. When the swash plate 8 rotates with the drive shaft 6, each piston 13 reciprocates in the axial direction of the drive shaft 6 inside the cylinder bore 12 through a crank mechanism composed of the rotary support member 7, the swash plate 8, the guide pin 9, and the shoe 14.

At the center of the rear housing 4, there is defined a suction chamber 15 facing the valve forming member 3, and, in the outer periphery of the suction chamber 15, there is defined a discharge chamber 16 surrounding the suction chamber 15.

Further, formed in the cylinder block 1 and the rear housing 4 is a communication passage 17 communicating between the crank chamber 5 and the discharge chamber 16, and, at some midpoint of the communication passage 17, there is arranged a displacement control valve 18 consisting of an electromagnetic valve. Further, formed in the cylinder block 1 is a bleeding passage 19 establishing constant communication between the crank chamber 5 and the suction chamber 15.

Further, the rear housing 4 has a suction port 20 exposed to the exterior, and communication is established between the suction port 20 and the suction chamber 15 by a suction passage 21. Halfway through the suction passage 21, there is formed a valve chamber 22 of an opening control valve V for movably adjusting the opening of the suction passage 21, and the suction chamber 15 is connected to the valve chamber 22 through a main suction port 23 and a sub suction port 24 formed in the inner wall surface of the valve chamber 22. Inside the valve chamber 22, there is movably accommodated a cylindrical valve body 25 for adjusting the opening of the suction passage 21. Further, a bottom portion 22*a* of the valve chamber 22 communicates with the crank chamber 5 through communication passages 26 and 17.

Figure 2:
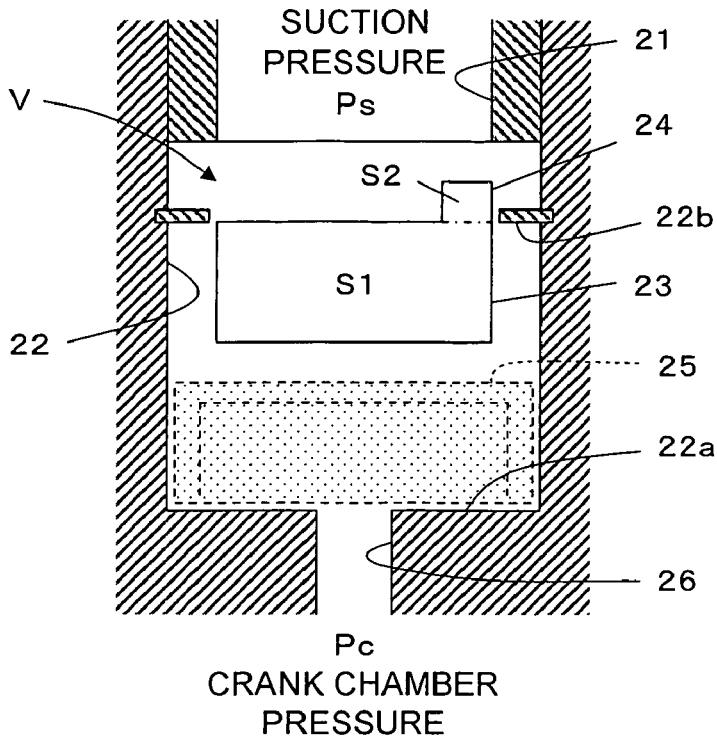
FIG. 2 is a schematic diagram showing the way an opening control valve behaves during maximum displacement operation in Embodiment 1.

As shown in FIG. 2, the main suction port 23 has a large opening area S1 in order to secure the flow rate during maximum displacement operation, whereas the sub suction port 24, which is formed adjacent to the main suction port 23 in the direction of the movement of the valve body 25, has a small opening area S2 in order to effect throttling to a level low enough to restrain the pressure fluctuation during variable displacement operation. The main suction port 23 is selectively opened and closed according to the movement of the valve body 25, whereas the sub suction port 24 is constantly open independently of the movement of the valve body 25. A suction pressure Ps acts on the front surface of the valve body 25 facing the suction port 20, and the pressure Pc of the crank chamber 5 acts on the rear surface of the valve body 25 facing the bottom portion 22*a* of the valve chamber 22.

In the portion of the inner wall surface of the valve chamber 22 near the boundary between the main suction port 23 and the sub suction port 24, there is arranged a stopper 22*b* for regulating the movement of the valve body 25.

Figure 3:
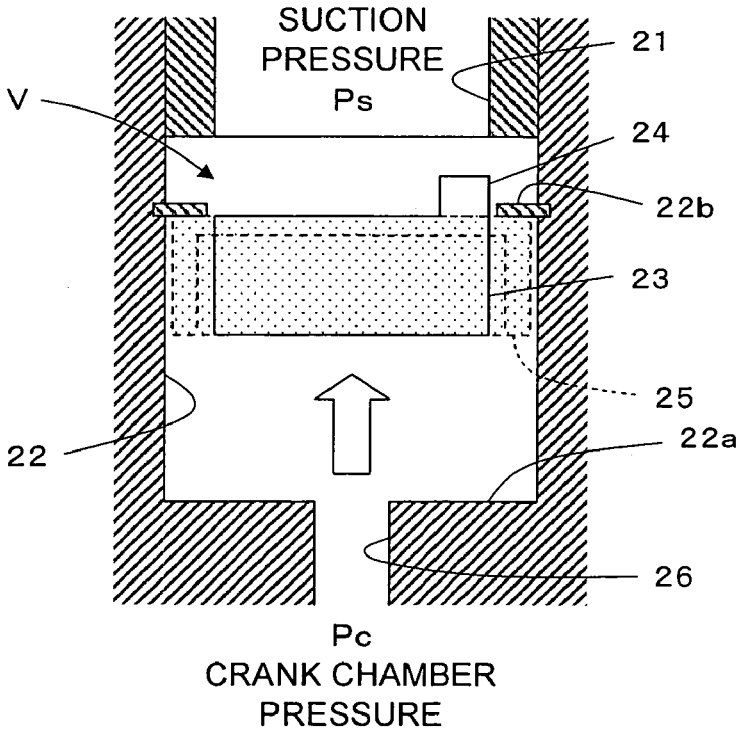
FIG. 3 is a schematic diagram showing the way the opening control valve behaves during variable displacement operation in Embodiment 1.

When the valve body 25 retracts inside the valve chamber 22 toward the bottom portion 22*a*, both the main suction port 23 and the sub suction port 24 are opened as shown in FIG. 2. Conversely, as shown in FIG. 3, when the valve body 25 advances inside the valve chamber 22 toward the suction port 20, the valve body 25 abuts the stopper 22*b* at a position where the main suction port 23 is totally closed, leaving solely the sub suction port 24 open.

Next, the operation of the variable displacement compressor according to Embodiment 1 will be described. When the drive shaft 6 rotates, the piston 13 move backwards, i.e., retract inside the cylinder bore 12, whereby refrigerant gas inside the suction chamber 15 pushes a suction reed portion away from a suction port 27 of the valve forming member 3, and flows into the cylinder bore 12, and, as a result of the subsequent forward movement, i.e., advancement of the piston 13 inside the cylinder bore 12, the refrigerant gas pushes a discharge reed portion away from a discharge port 28 of the valve forming member 3 and is discharged into the discharge chamber 16.

The opening of the displacement control valve 18 varies, whereby control is effected on the balance between the amount of gas introduced into the crank chamber 5 from the discharge chamber 16 through the communication passage 17 and the amount of gas exhausted into the suction chamber 15 from the crank chamber 5 through the bleeding passage 19, thereby determining the pressure Pc of the crank chamber 5. When the opening of the displacement control valve 18 is changed to thereby change the pressure Pc of the crank chamber 5, the pressure difference between the crank chamber 5 and the cylinder bore 12 with the piston 13 therebetween is changed, thereby changing the tilting angle of the swash plate 8. As a result, the stroke of the piston 13, that is, the discharge displacement of the compressor, is adjusted.

For example, when the pressure Pc of the crank chamber 5 is lowered, the tilting angle of the swash plate 8 increases, and the stroke of the piston 13 increases, resulting in an increase in discharge displacement. Conversely, when the pressure Pc of the crank chamber 5 is raised, the tilting angle of the swash plate 8 decreases, and the stroke of the piston 13 is reduced, resulting in a reduction in discharge displacement.

During maximum displacement operation, the pressure Pc of the crank chamber 5 is reduced through setting of the opening of the displacement control valve 18, and becomes substantially equal to the suction pressure Ps. When the crank chamber pressure Pc becomes substantially equal to the suction pressure Ps, there is no more urging force due to the crank chamber pressure Pc overcoming the suction pressure Ps to urge the valve body 25 so as to decrease the opening of the suction port 20. As a result, due to the gas flowing into the suction chamber 15 from the suction port 20 through the suction passage 21, the valve body 25 of the opening control valve V retracts inside the valve chamber 22 toward the bottom portion 22*a*. This causes, as shown in FIG. 2, both the main suction port 23 and the sub suction port 24 to be totally opened, with the opening area becoming S1+S2. This allows discharge of maximum displacement. At this time, no urging force due to the spring, etc. is acting on the valve body 25 of the opening control valve V, so that there is substantially no energy loss when the valve body 25 retracts, whereby the performance at the time of maximum displacement operation is secured.

During variable displacement operation, the pressure Pc of the crank chamber 5 is raised through setting of the opening of the displacement control valve 18, and becomes higher than the suction pressure Ps. Thus, the valve body 25 of the opening control valve V advances inside the valve chamber 22 toward the suction port 20, and, as shown in FIG. 3, a state is attained in which the main suction port 23 is totally closed, with solely the sub suction port 24 being open. That is, the opening area is S2. As a result, the passage for the suction gas is throttled, and the propagation of the pressure fluctuation is restrained to a sufficient degree.

While in Embodiment 1 the main suction port 23 and the sub suction port 24 are open in the inner wall surface of the valve chamber 22, and the main suction port 23 is opened and closed through movement of the cylindrical valve body 25 inside the valve chamber 22, this should not be construed restrictively. It is also possible to adopt a construction in which the main suction port and the sub suction port are formed to be open in the valve body moving inside the valve chamber 22 and in which the main suction port is opened and closed through movement of this valve body.

Embodiment 2

Figure 4:
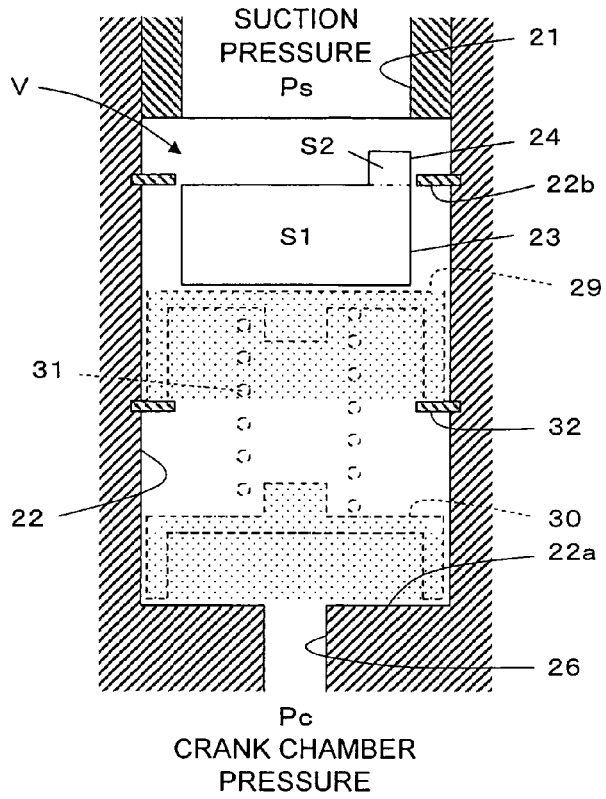
FIG. 4 is a schematic diagram showing the way an opening control valve behaves during maximum displacement operation in Embodiment 2.

FIG. 4 shows the construction of the opening control valve of a variable displacement compressor according to Embodiment 2. In the valve chamber 22 of the opening control valve V, a cylindrical valve body 29 is movably accommodated, and, on the rear side of the valve body 29, a cylindrical movable member 30 is movably accommodated. Between the valve body 29 and the movable member 30, there is arranged a spring 31 serving as an urging member urging these two members so as to move them away from each other. Further, in the portion of the inner wall portion of the valve chamber 22 between the valve body 29 and the movable member 30, there is arranged a stopper 32 for regulating the movement of the movable member 30. The suction pressure Ps acts on the front surface of the valve body 29 through the suction passage 21 so as to open the suction ports 23 and 24, and the pressure Pc of the crank chamber 5 acts on the rear surface of the movable member 30 through the communication passage 26 so as to close the suction port 23. Otherwise, this embodiment is of the same construction as Embodiment 1.

During maximum displacement operation, the pressure Pc of the crank chamber 5 is substantially equal to the suction pressure Ps, so that the valve body 29 is pressed by the suction gas flow toward the bottom portion 22*a* inside the valve chamber 22, and the movable member 30 is caused to retract by the valve body 29 to a position where the opening of the suction passage is maximum and where the urging force of the spring 31 is weakened or substantially ceases to act. As a result, both the main suction port 23 and the sub suction port 24 are totally opened, and the opening area becomes S1+S2. At this time, it is possible to substantially eliminate the effect of throttling the suction ports 23 and 24 due to the valve body 29, making it possible to secure the performance at the time of maximum displacement operation in which high efficiency is required of the compressor.

Figure 5:
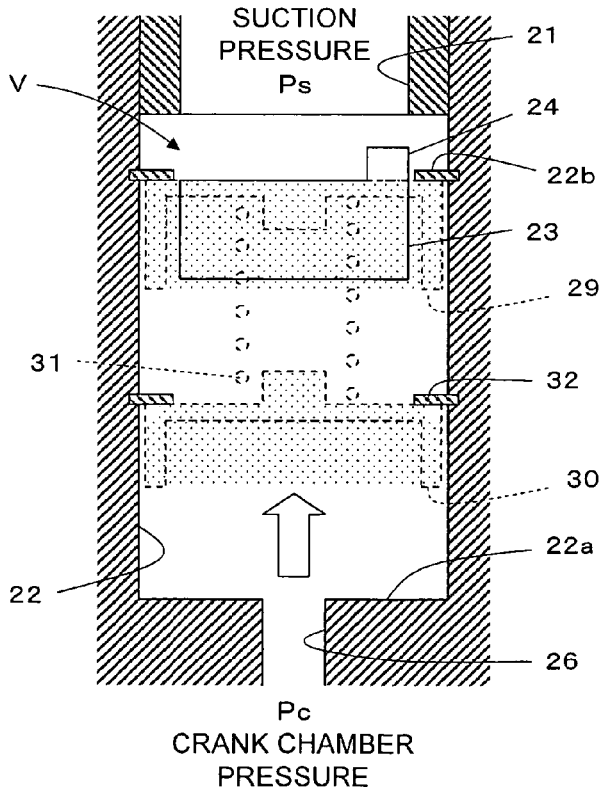
FIG. 5 is a schematic diagram showing the way the opening control valve behaves during variable displacement operation in Embodiment 2.

During variable displacement operation, the pressure Pc of the crank chamber 5 is raised to become higher than the suction pressure Ps, so that the movable member 30 advances inside the valve chamber 22, whereby the spring 31 acts on the valve body 29 so as to decrease the opening of the suction passage against the suction pressure Ps and the suction gas flow. As a result, the suction passage is gradually throttled. As shown in FIG. 5, when the movable member 30 abuts the stopper 32, the advancement of the movable member 30 is stopped, and the urging force acting on the valve body 29 by the spring 31 is exerted to a maximum degree, the throttle effect being increased against the flow rate of the suction gas. As a result, the main suction port 23 is totally closed by the valve body 29, and solely the sub suction hole 24 is open, thereby restraining the propagation of the pressure fluctuation to a sufficient degree.

Similarly, also when starting is effected in the OFF displacement state, in which the effect of throttling the suction passage is required, that is, in the minimum displacement operating state, the movable member 30 is caused to advance by the pressure Pc of the crank chamber 5 until it abuts the stopper 32 as shown in FIG. 5, and a state is attained in which the urging force exerted on the valve body 29 by the spring 31 is strong. Thus, at the time of displacement restoring start, in which the displacement starts to grow, a high throttling effect is obtained against the flow rate of the suction gas, and the propagation of the fluctuation in pressure is restrained to a sufficient degree, thereby preventing generation of noise, etc.

In this embodiment, the space between the valve body 29 and the movable member 30 is substantially hermetically closed to thereby obtain a damper effect, and generation of noise due to vibration of the valve body 29 itself caused by suction pulsation is prevented, and, further, a throttle effect is ensured.

Figure 6:
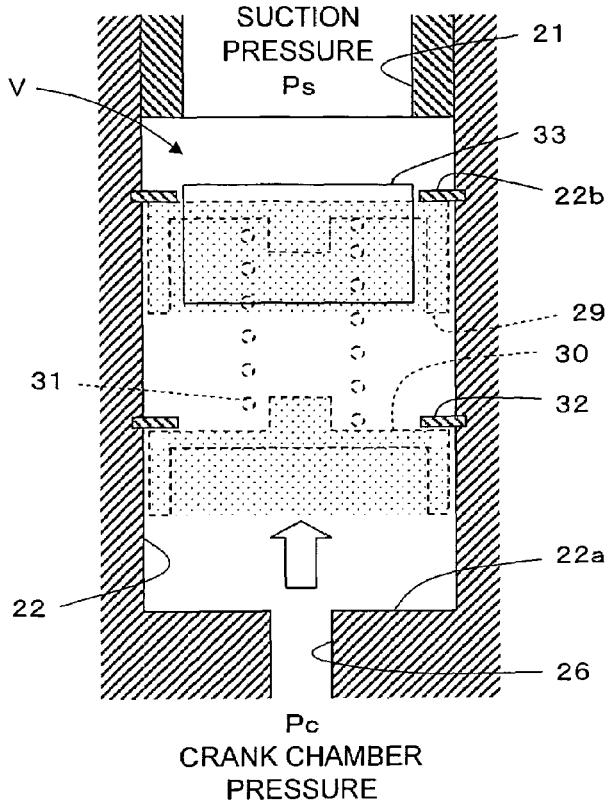
FIG. 6 is a schematic diagram showing the way the opening control valve behaves during variable displacement operation in a modification of Embodiment 2.

While in Embodiment 2 the main suction port 23 with a large opening area S1 and the sub suction port 24 with a small opening area S2 are formed in the inner wall surface of the valve chamber 22, it is also possible to adopt a construction as shown in FIG. 6, in which one suction port 33 is formed in the inner wall surface of the valve chamber 22; during maximum displacement operation, the valve body 29 is retracted to totally open the suction port 33, and during variable displacement operation and in the OFF displacement state, the valve body 29 advances to abut the stopper 22*b*, whereby only a part of the suction port 33 is opened to throttle the suction gas passage.

Figure 7:
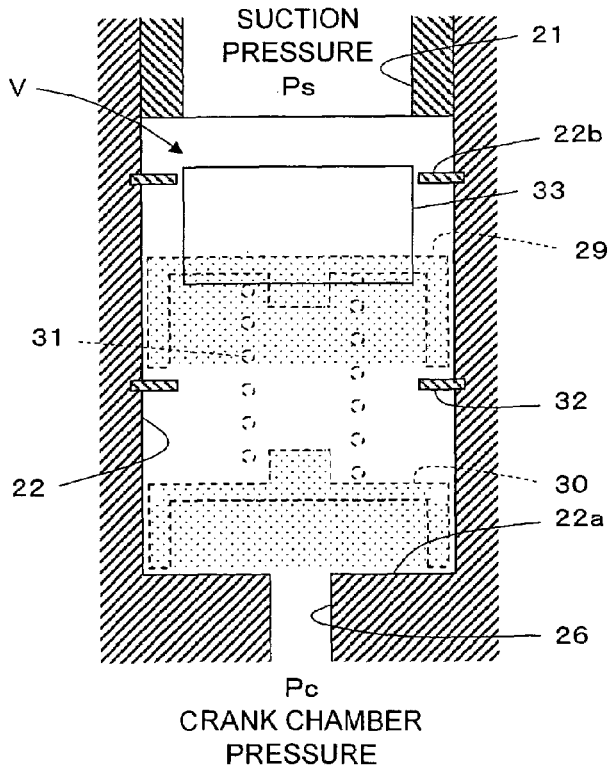
FIG. 7 is a schematic diagram showing the way the opening control valve behaves during maximum displacement operation in another modification of Embodiment 2.

Further, as long as the requisite opening area for maximum displacement operation can be obtained, it is also possible, as shown in FIG. 7, for the suction port 33 to be kept partially closed by the valve body 29 during maximum displacement operation instead of being totally opened.

Embodiment 3

Figure 8:
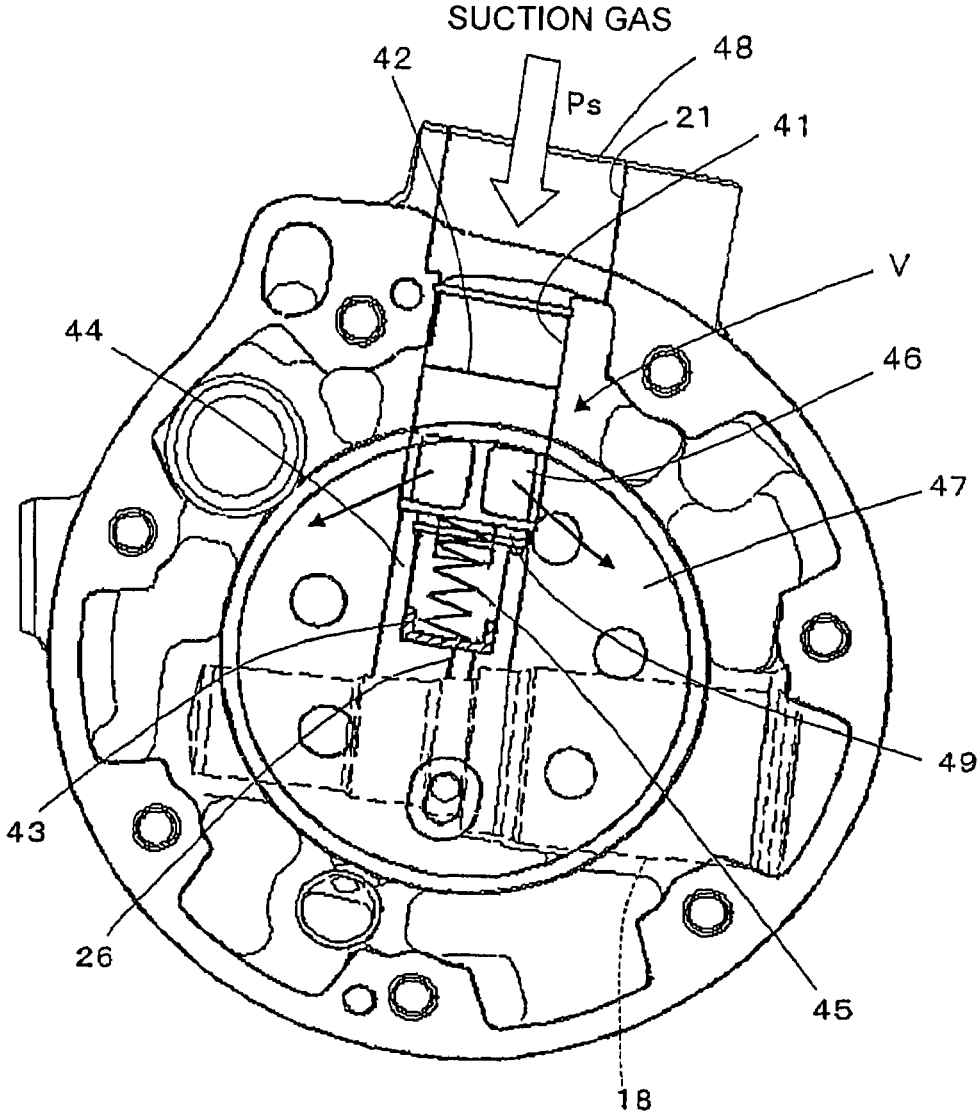
FIG. 8 is a diagram showing the way an opening control valve behaves during maximum displacement operation in Embodiment 3.

FIG. 8 shows the construction of a variable displacement compressor according to Embodiment 3 of the present invention. A valve body 42 in the form of a bottomed cylinder is movably accommodated in a valve chamber 41 of the opening control valve V, and on the rear side of the valve body 42, a cylindrical movable member 43 is movably arranged inside a guide portion 44. Between the valve body 42 and the movable member 43, there is arranged a spring 45 serving as an urging member urging them away from each other. A suction port 46 is formed in the side surface of the valve body 42, and the suction port 46 is exposed partially or entirely inside a suction chamber 47 according to the position of the valve body 42 in the valve chamber 41, whereby communication is established between a suction port 48 and the suction chamber 47. That is, based on the position of the valve body 42 inside the valve chamber 41, the effective area of the suction port 46 is adjusted, and the opening of the suction passage is controlled. Further, near the forward end portion of the guide portion 44, there is arranged a stopper 49 for regulating the movement of the movable member 43.

The suction pressure Ps acts on the front surface of the valve body 42, and the pressure Pc of the crank chamber acts on the rear surface of the movable member 43 through the communication passage 26.

During maximum displacement operation, the pressure Pc of the crank chamber is substantially equal to the suction pressure Ps, so that the valve body 42 is pushed within the valve chamber 41 toward the suction chamber 47 by the suction gas flow, and is retracted together with the movable member 43 together with the spring 45. As shown in FIG. 8, when the movable member 43 thus reaches the bottom portion of the guide portion 44, the valve body 42 also abuts the forward end portion of the guide portion 44, and the suction port 46 formed in the side surface of the valve body 42 is widely exposed within the suction chamber 47, with the opening of the suction passage being maximum to secure the performance at the time of maximum displacement operation.

Figure 9:
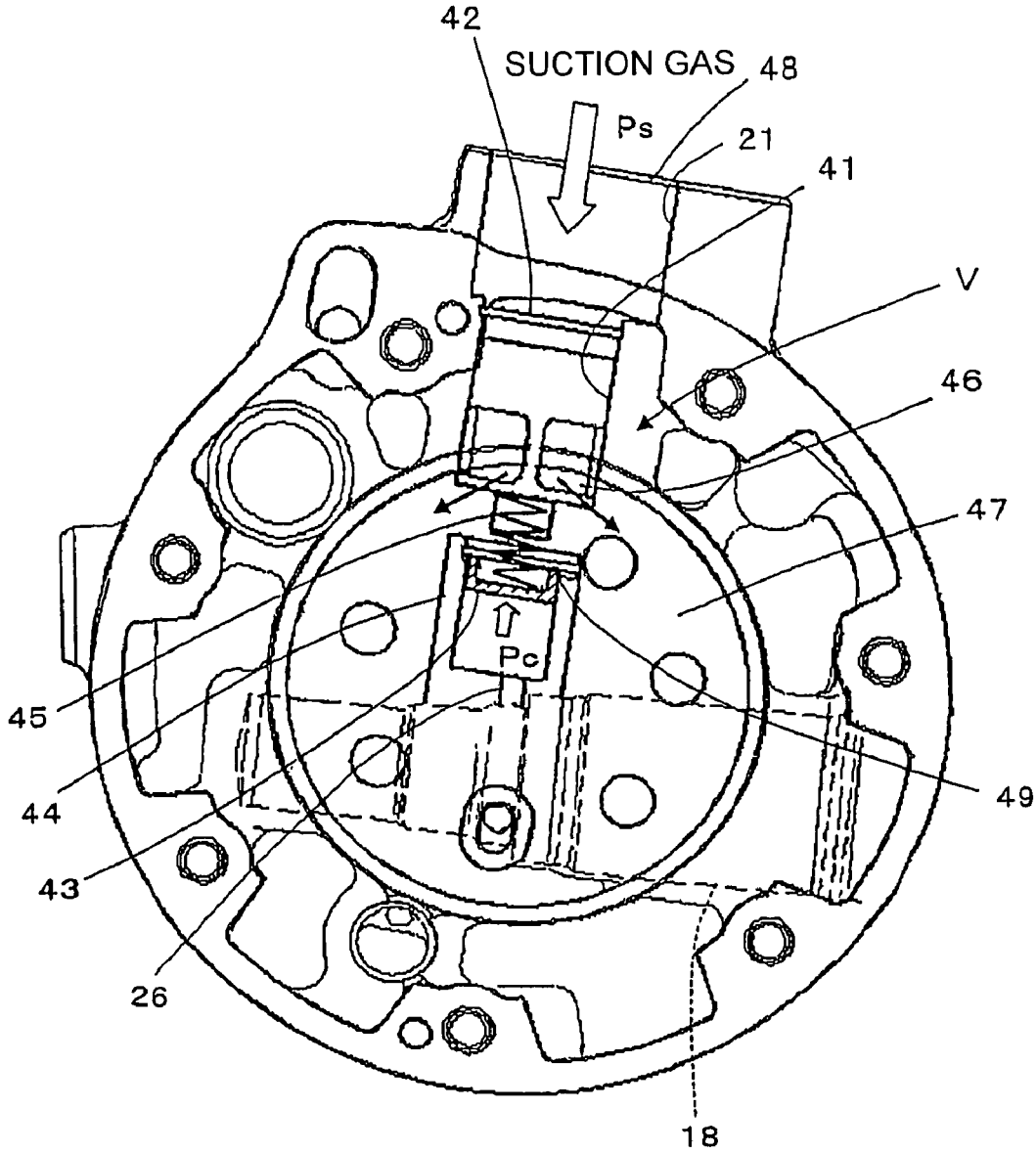
FIG. 9 is a diagram showing the way the opening control valve behaves during variable displacement operation in Embodiment 3.

During variable displacement operation, the pressure Pc of the crank chamber is raised to become higher than the suction pressure Ps, so that the movable member 43 advances within the guide portion 44, causing the valve body 42 to advance through the spring 45; the higher the pressure Pc of the crank chamber, that is, the smaller the displacement, the more strongly the urging force due to the spring 45 is exerted on the valve body 42 so as to reduce the opening area of the suction port 46. As shown in FIG. 9, when the movable member 43 abuts the stopper 49, the advancement of the movable member 43 is stopped, and the urging force acting on the valve body 42 due to the spring 45 is strengthened, enhancing the throttle effect against the flow rate of the suction gas. As a result, a state is attained in which the effective area of the suction port 46 exposed within the suction chamber 47 is kept small, whereby the pressure fluctuation is restrained to a sufficient degree.

Similarly, also in the OFF displacement state, the movable member 43 is caused to advance by the pressure Pc of the crank chamber until it abuts the stopper 49 as shown in FIG. 9, and a state is attained in which the urging force exerted on the valve body 42 by the spring 45 is strong. Thus, at the time of displacement restoring start, when the displacement starts to grow, a great throttle effect is obtained against the flow rate of the suction gas, and the propagation of the pressure fluctuation is restrained to a sufficient degree, preventing generation of noise, etc.

Further, as shown in FIG. 8, the movable member 43 has a diameter smaller than that of the valve body 42, and the pressure reception area with which the movable member 43 receives the pressure Pc of the crank chamber is smaller than the pressure reception area with which the valve body 42 receives the suction pressure Ps. As a result, the influence of the pressure Pc of the crank chamber is mitigated, and it is possible to effect setting such that when the pressure Pc of the crank chamber is raised beyond a predetermined value, the movable member 43 advances to enhance the urging force of the spring 45.

In this way, by varying the relationship between the pressure reception area of the movable member 43 and the pressure reception area of the valve body 42, it is possible to adjust the timing with which the urging force of the spring 45 is enhanced with respect to the pressure Pc of the crank chamber.

While in Embodiment 3 described above the valve body 42 abuts the forward end portion of the guide portion 44 to make the opening of the suction passage maximum during maximum displacement operation, it is also possible to adopt an arrangement in which, even in the state in which the movable member 43 has reached the bottom portion of the guide portion 44 during maximum displacement operation, the valve body 42 is away from the forward end portion of the guide portion 44 by means of the urging force of the spring 45. This arrangement makes it possible to exert throttle function for a fluctuation in the suction gas flow rate also during maximum displacement operation.

Embodiment 4

Figure 10:
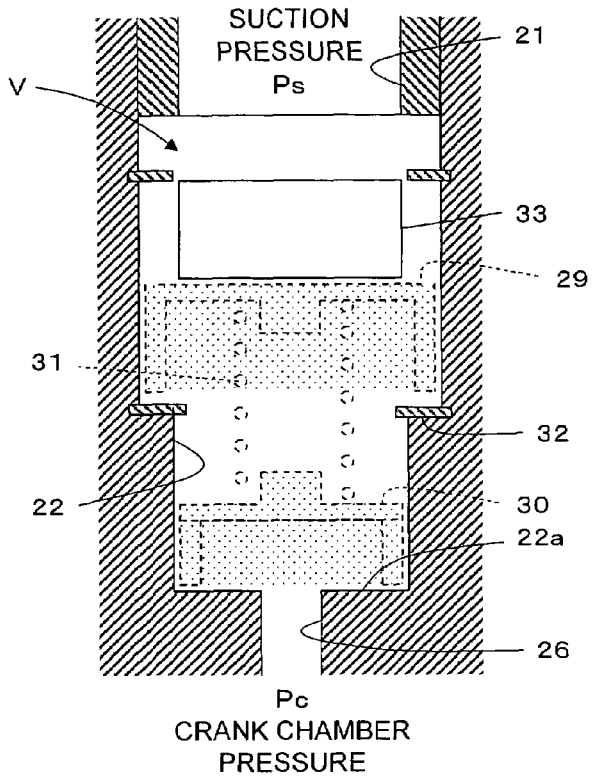
FIG. 10 is a schematic diagram showing the way an opening control valve behaves during maximum displacement operation in Embodiment 4.

FIG. 10 shows the construction of the opening control valve of a variable displacement compressor according to Embodiment 4 of the present invention. In Embodiment 4, the opening control valve of Embodiment 2 is modified such that the pressure reception area with which the movable member 30 receives the pressure Pc of the crank chamber 5 is smaller than the pressure reception area with which the valve body 29 receives the suction pressure Ps. As a result, as in Embodiment 3, the influence of the pressure Pc of the crank chamber 5 is mitigated, and it is possible to effect setting such that when the pressure Pc of the crank chamber 5 exceeds a predetermined value, the movable member 30 advances to enhance the urging force of the spring 31.

By varying the relationship between the pressure reception area of the movable member 30 and pressure reception area of the valve body 29, it is possible to adjust the timing with which the urging force of the spring 31 is enhanced with respect to the pressure Pc of the crank chamber 5.

Further, as in Embodiment 2, a hermetic space is formed between the valve body 29 and the movable member 30 to thereby obtain a damper effect, and the suction port 33 is adapted to be closed by the valve body 29 when the displacement is minimum.

Embodiment 5

Figure 11:
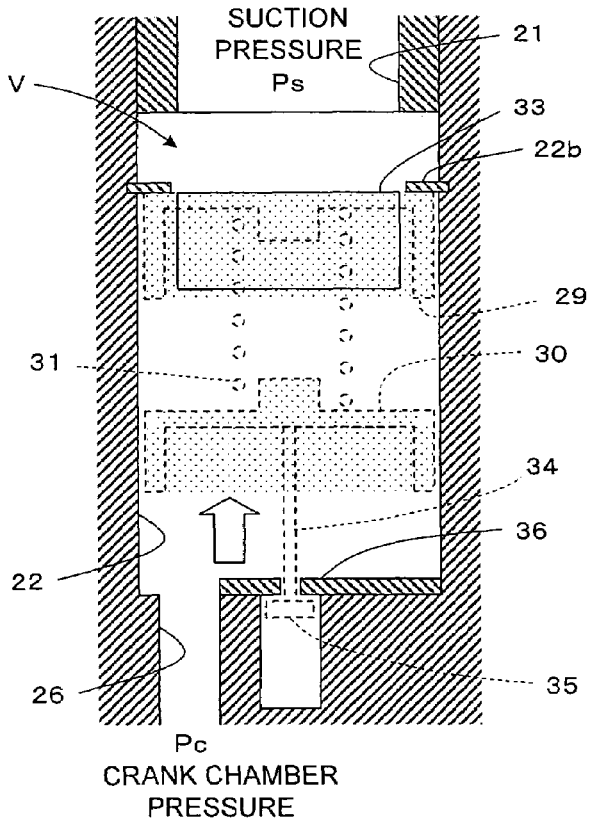
FIG. 11 is a schematic diagram showing the way an opening control valve behaves during variable displacement operation in Embodiment 5.

FIG. 11 shows the construction of the opening control valve of a variable displacement compressor according to Embodiment 5 of the present invention. In Embodiment 5, the opening control valve of Embodiment 2 is modified such that, instead of arranging the stopper 32 for regulating the movement of the movable member 30 between the valve body 29 and the movable member 30, a lock member 35 is mounted to the back portion of the movable member 30 through the intermediation of a rod 34, and there is provided inside the valve chamber 22 a plate-like stopper 36 through which the rod 34 extends. Also in this construction, it is possible to stop the movement of the movable member 30 causing the lock member 35 to abut the stopper 36.

Also in an opening control valve of a construction in which, as in Embodiment 3, the opening of the suction passage is adjusted by moving the valve body in which the suction port is formed, it is possible, as in Embodiment 5, to arrange a stopper on the back portion of the movable member to stop the movement of the movable member.

While in Embodiments 1 through 3 the valve body does not totally close the suction passage at the time of OFF displacement and communication is constantly maintained between the suction passage at the upstream side of the opening control valve and the suction chamber, it is also possible, as in Embodiments 4 and 5, to adopt a construction in which the suction passage is totally closed during variable displacement operation and OFF operation.

According to the present invention, there is provided in the suction passage an opening control valve which movably adjusts the opening of the suction passage based on the pressure difference between the suction pressure and the crank chamber pressure that varies according to the displacement, so that during maximum displacement operation, it is possible to maintain a sufficient opening and there is no fear of a deterioration in performance, and, during small displacement operation, which requires a reduction in the propagation of the pulsation, it is possible to sufficiently throttle the opening of the suction passage to a sufficient degree.

What is claimed is:

1. A variable displacement compressor in which variable control of displacement is effected through adjustment of a crank chamber pressure, comprising:

a suction port;

a suction chamber;

a suction passage establishing communication between the suction port and the suction chamber; and an opening control valve arranged in the suction passage and adapted to adjust an opening of the suction passage based on a pressure difference between a suction pressure in the suction port and the crank chamber pressure, wherein the opening control valve includes:

a valve chamber;

a valve body movably arranged inside the valve chamber, said valve body receives the suction pressure so as to experience a suction pressure force acting in a direction of the suction port being opened;

a communication passage establishing communication between the crank chamber and the valve chamber;

a movable member movably arranged inside the valve chamber, said movable member receives the crank chamber pressure introduced into the valve chamber through the communication passage so as to experience a crank chamber pressure force in a direction of the suction port being closed; and an urging member urging the movable member and the valve body away from each other.

2. A variable displacement compressor according to claim 1, wherein the opening control valve makes the opening of the suction passage larger during maximum displacement operation than during variable displacement operation.

3. A variable displacement compressor according to claim 2, wherein, during maximum displacement operation, the opening control valve makes the opening of the suction passage maximum.

4. A variable displacement compressor according to claim 1, wherein during maximum displacement operation, the movable member is caused to retract by the valve body to a position where the opening of the suction passage is greatest and moves to a position where the urging force of the urging member ceases to act and wherein, during variable displacement operation, the movable member moves to a position where the opening of the suction passage is throttled by the valve body.

5. A variable displacement compressor according to claim 1, further comprising a stopper that regulates movement of the movable member.

6. A variable displacement compressor according to claim 5, wherein the stopper is arranged between the valve body and the movable member.

7. A variable displacement compressor according to claim 1, wherein a pressure reception area of the valve body and a pressure reception area of the movable member differ from each other.

8. A variable displacement compressor according to claim 7, wherein the pressure reception area of the movable member is smaller than the pressure reception area of the valve body.

9. A variable displacement compressor according to claim 1, wherein an opening communicating with the suction passage is formed in an inner wall surface of the valve chamber of the opening control valve, and wherein the effective area of the opening determining the opening of the suction passage is adjusted in accordance with the position of the valve body movably arranged inside the valve chamber.

10. A variable displacement compressor according to claim 1, wherein communication is constantly maintained between the suction passage at the upstream side of the opening control valve and the suction chamber.

11. A variable displacement compressor according to claim 1, further comprising:

a cylinder block defining a plurality of cylinder bores;

a front housing connected to a front end portion of the cylinder block and defining the crank chamber;

a rear housing connected to a rear end portion of the cylinder block and defining the suction chamber, the suction port, and the suction passage;

a drive shaft rotatably supported by the cylinder block and the front housing; and a plurality of pistons slidably and respectively accommodated in the plurality cylinder bores and connected to the drive shaft through a crank mechanism accommodated in the crank chamber.

12. A variable displacement compressor according to claim 11, wherein the opening control valve is arranged in the rear housing.

13. A variable displacement compressor according to claim 12, wherein the communication passage establishing communication between the crank chamber and the valve chamber of the opening control valve is formed in the cylinder block and the rear housing.

14. A variable displacement compressor according to claim 11, further comprising:

a discharge chamber formed in the rear housing;

a second communication passage establishing communication between the crank chamber and the discharge chamber;

a bleeding passage establishing communication between the crank chamber and the suction chamber; and a displacement control valve arranged on the second communication passage and adapted to control the pressure in the crank chamber through adjustment of the opening of the second communication passage.

* * * * *